United States Patent [19]

Salvat et al.

[11] 4,241,353

[45] Dec. 23, 1980

[54] MULTIMODE MONOPULSE FEED AND ANTENNA INCORPORATING SAME

[75] Inventors: Francois Salvat; Jean Bouko; Claude Coquio, all of Paris, France

[73] Assignee: Thomson-CSF, Paris, France

[21] Appl. No.: 13,272

[22] Filed: Feb. 21, 1979

[30] Foreign Application Priority Data

Feb. 24, 1978 [FR] France ..... 78 05337

[51] Int. Cl.[3] ..... H01Q 13/02

[52] U.S. Cl. ..... 343/786

[58] Field of Search ..... 343/776, 778, 786

[56] References Cited

U.S. PATENT DOCUMENTS 3,701,163 10/1972 Grabowski ..... 343/786

*Primary Examiner*—Eli Lieberman

*Attorney, Agent, or Firm*—Karl F. Ross

[57] ABSTRACT

A mixed E-plane and H-plane multimode monopulse feed is formed by a multimode E-plane horn structure, in the aperture of which metal bars or plates are arranged parallel to the electrical field. The bars or plates form discontinuities at which an odd mode of the $H_{30}$ type is generated, the feed as a whole thus becoming a multimode H-plane structure. Such a feed is very useful for the production of multimode monopulse antennas of reduced dimensions.

9 Claims, 8 Drawing Figures

PRIOR ART
Fig_1
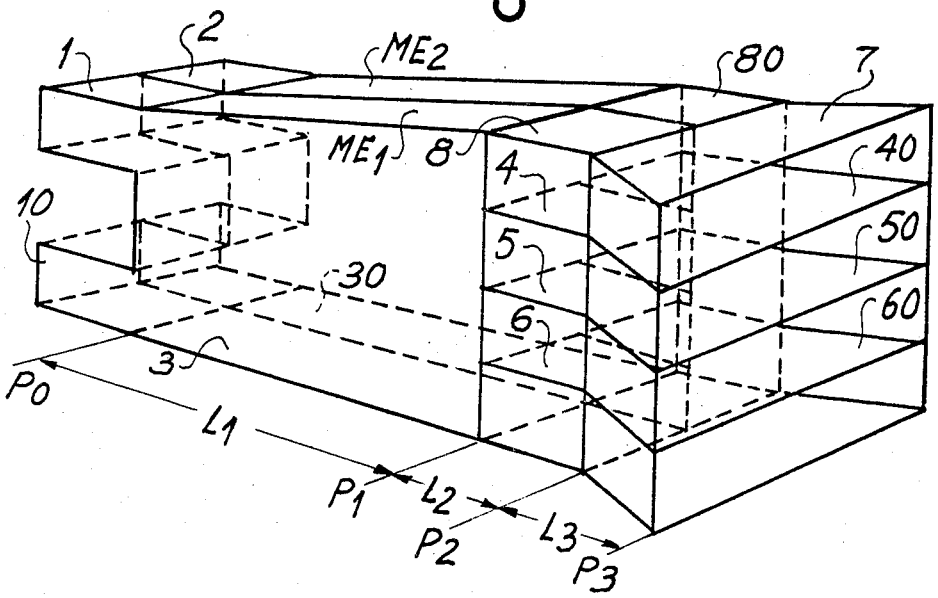
Fig_2
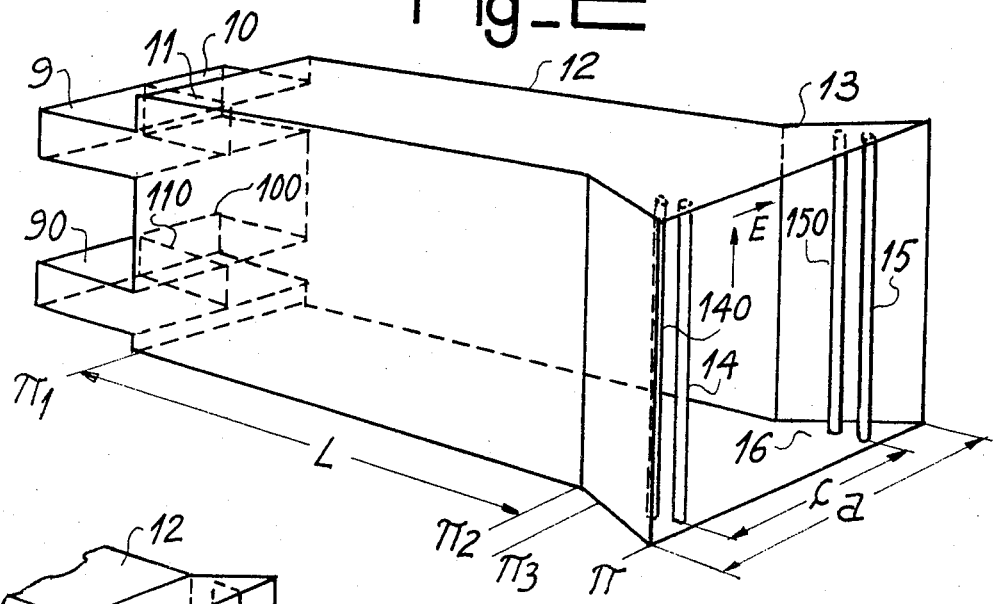
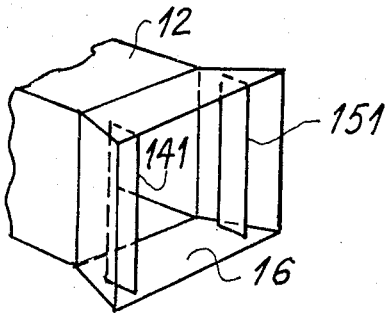
Fig_3

MULTIMODE MONOPULSE FEED AND ANTENNA INCORPORATING SAME

FIELD OF THE INVENTION

The present invention relates to the field of multimode monopulse feeds and to that of so-called monopulse antennas which incorporate such feeds.

BACKGROUND OF THE INVENTION

In monopulse antennas, a plurality of radiation patterns are made use of simultaneously and the shapes of the patterns have a direct bearing on the overall performance of the radar system employing the antennas. In monopulse techniques, simultaneous use is in fact made of a plurality of patterns originating from the same antenna. In so-called amplitude operation, for example, a distinction is made between on the one hand a pattern of even symmetry or sum diagram, which acts as a reference, and on the other hand patterns of odd symmetry or "difference" patterns which provide signals which represent deviations in azimuth and elevation from the axis of the antenna.

In so-called "phase" operation, the signals for the angular deviations are obtained by a phase comparison between two patterns having the same amplitude characteristic. It should incidentally be mentioned that it is possible to change over from one mode of operation to the other by means of a coupler system and it will therefore only be the case of amplitude operation which will be considered in the following description.

In these various modes of operation, the patterns employed can be represented mathematically by orthogonal functions, which means that the corresponding channels are decoupled. However, the various radiation characteristics of these patterns, which have a direct bearing on the performance of the system, are not independent of one another a priori but are related by limiting relationships depending on the structure of the antenna. These characteristics are gain and the level of the side lobes on the sum channel and the difference channels, the slope close to the axis, and the gain of the main lobes on the difference channels.

For a given antenna structure, the problem which is posed comes down to finding an optimum balance between the factors which have been mentioned while keeping them in the order of importance imposed by the functions of the system concerned. It can be deduced from this that any structure has a range where it is optimum but it is precisely in the case of monopulse techniques that conventional antenna structures have revealed their limitations. In conventional monopulse antennas, it has in fact been found impossible to control the sum pattern and the difference patterns independently of one another, or to control properly the form of the illumination characteristic of the primary feed which is of importance mainly in the construction of low-noise antennas for radio-astronomy and space telecommunications. The limitations of conventional monopulse techniques have also been shown up when they have been applied to antennas for tropospheric-scatter communication where diversity between the "sum" and "difference" channels is utilized.

To overcome these limitations, so called multimode feeds have been developed and are used in antennas which are also termed multimode.

By virtue of the structure with which it is endowed, a multimode feed, also called a moder, is capable of generating direct propagative modes whose phases and amplitudes can be controlled to allow a desired illumination to be obtained in its aperture.

In general terms, a moder is a structure formed from waveguides containing discontinuities designed to generate upper modes.

A study of such moders may be found, inter alia, in French Pat. No. 1,290,275, of whose FIG. 1 will be reviewed herein, and which relates to a mixed-multimode structure representative of the prior art which is formed by combining an E-plane moder and an H-plane moder in the way shown in FIG. 1.

Such a structure enables independent control to be achieved of the sum and difference patterns in the E plane and the H plane. However, such control is not exercised simultaneously in the E and H planes but successively in the E plane and then the H plane.

The structure shown in FIG. 1 is formed by two plane moders $ME_1$ and $ME_2$ which are positioned side by side and which are separated by a common vertical partition. The moders are each excited by one of two pairs of guides 1, 10 and 2, 20 which receive the fundamental mode and which each open into a guide 3, 30 having a length $L_1$ between planes $P_0$ and $P_1$. Plane $P_0$ is called a plane of discontinuity at which upper, propagative or evanescent, modes are formed, the length $L_1$ and the dimensions of guides 3, 30 being such that only the desired modes, which in the present instance for example are the odd $H_{11}$ and $E_{11}$ modes and the even $H_{12}$ and $E_{12}$ modes, are propagated to the aperture of the E moder so formed, that is to say plane $P_1$, the fundamental mode of excitation being the $H_{10}$ mode.

Following on from plane $P_1$ are H-plane moders which will produce the desired patterns of distribution in the horizontal plane without upsetting the distribution patterns produced in the vertical plane by the E moders $ME_1$ and $ME_2$.

Metal plates 4, 40, 5, 50, 6, 60 are arranged horizontally in a guide 8, 80 of length $L_2$ which forms a continuation of guides 3 and 30 beyond plane $P_1$ and these plates define four pairs of flat horizontal guides which are adjacent at their small sides and which are excited with the patterns of distribution defined by moders $ME_1$ and $ME_2$. The horizontal plates extend past plane $P_2$ into a guide 7 of length $L_3$ in the shape of a horn.

The assembly situated between planes $P_1$ and $P_3$ forms a set of superimposed H-plane moders, plane $P_2$ being the plane of discontinuity at which the upper modes are formed. The aperture of the mixed structure, which is situated in plane $P_3$, radiates with an overall illumination characteristic which is the product of the partial illumination characteristics obtained in the vertical plane and the horizontal plane.

Multimode sources conforming to what has just been described are used in antennas but they have the drawback of being of considerable size longitudinally, which is a hindrance when producing certain antennas where any increase in performance, in particular in respect of pass band, results in an increase in inertia which has an adverse effect on the operation of the servo-mechanisms.

SUMMARY OF THE INVENTION

The present invention has as an object to define a multimode feed which is not subject to the disadvantages referred to above and which is considerably smaller in size than the prior-art feed.

In accordance with the invention, the multimode structure comprises a waveguide member forming a cavity which terminates in a horn, at least four supply waveguides which are so disposed as to form at least two pairs of horizontal guides and two pairs of vertical guides, and at least two metal bars or plates arranged in the radiating aperture of the structure.

Such a structure, whose longitudinal dimensions are considerably smaller than those of a comparable prior-art structure, has the advantage of possessing a wider operating pass band.

BRIEF DESCRIPTION OF THE DRAWING

Other advantages and features of the invention will become more apparent from the following description taken in conjunction with the accompanying drawing wherein:

FIG. 1, already referred to, illustrates a prior-art moder structure;

FIG. 2 is a mixed E-plane and H-plane moder structure according to the invention;

FIG. 3 shows a modification in which plates are used;

DETAILED DESCRIPTION

Figure 4:
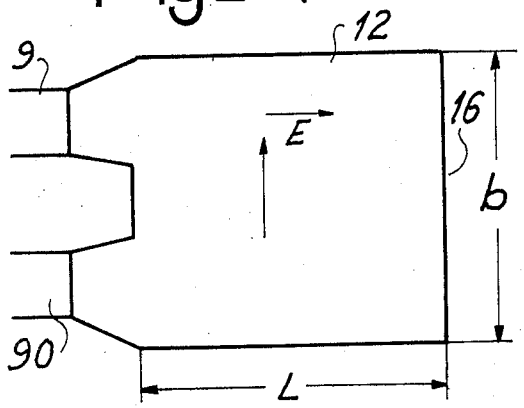
FIG. 4 is a view of the moder in the E-plane.

In the introduction to the present specification, reference was made to a relevant prior-art design of a mixed E-plane and H-plane moder to indicate the disadvantages which such a moder has when used as the primary feed of a multimode antenna for which an increase in performance, in particular in respect of passband, is required. In this case, owing to its dimensions and weight and particularly when a point at which to fit it is already provided, the moder requires the reflector of the antenna to be moved in a direction such that the inertia of the assembly tends to increase, which has an adverse effect particularly on the servo-mechanisms.

The reduced length of the moder according to the invention overcomes this limitation and makes it possible to produce a high-performance multimode antenna. This reduction in size, and the attendant reduction in weight, is particularly useful when constructing antennas of the Cassegrain type mounted on turrets, where the inertia problems which arise are more acute on account of the limited amount of space available between the reflector and the mounting axis.

With reference to FIG. 2, a description will now be given of the structure of a mixed E-plane and H-plane moder according to the invention.

Such a moder comprises chiefly a waveguide 12 forming a cavity which continues into a horn 13 whose mouth forms the radiating aperture of the moder. The overall length of the moder so formed is equal to L and the size of its rectangular aperture is a in the case of its major dimension and b in the case of its minor dimension, which in the present case is vertical. A number of supply guides are provided, four in the present case, which are identified by reference numerals 9, 10, 90, 100. The layout of these guides is identical to that of the supply guides of the mixed structure shown in FIG. 1. Guides 9 and 10 adjoin one another at a common vertical wall 11. They are arranged in an upper horizontal plane whereas guides 90 and 100, which are separated by at a vertical wall 110, are arranged in a lower horizontal plane.

Grouped in this way, the guides form a supply for an H-plane moder.

The guides may be grouped in pairs vertically to form exciting guides 9, 90 and 10, 100 for two E-plane moders, with intervening partitions 11 and 110.

In the embodiment being described, two metal bars 14, 15 are arranged in the plane of the aperture 16, or plane $\pi$, at a distance c from one another which is less than dimension a. It will be noted that the cylindrical bars mentioned may be replaced by plates 141, 151 as shown in FIG. 3.

The supply guides open into a straight guide 12 in a plane $\pi$, which is a plane of discontinuity at which the upper modes are formed from the excitation mode transmitted by the guides, that excitation mode being generally the fundamental mode.

We shall now explain the operation of the mixed moder which has been described with reference to FIG. 2.

It should first of all be mentioned that in the E plane the feed described operates in the conventional manner.

Use will be made of the mathematical expressions for the fields obtained across the radiating aperture as already given in the above-identified French patent, or in other earlier publications, but in simplified form.

The length L of the moder according to the invention is selected in such a way that the $H_{10}$ and $EH_{12}$ modes are brought into phase at the aperture 16 at the center frequency. It will be recalled that $EH_{12}$ mode is a convenient way of referring to the $E_{12}$ and $H_{12}$ modes generated in the plane of discontinuity 1 from the fundamental exciting mode $H_{10}$. These $E_{12}$ and $H_{12}$ modes have the same cut-off frequency and the same phase velocity and when superimposed can be considered as a single mode.

The field across the aperture 16 on the sum channel is of the form $$S_E = 1 + \frac{T_3}{T_1} \cos \frac{2\pi y}{b}$$

and on the difference channel it is:

$$D_E = \sin(\pi y/b),$$

with $|y| < b/2$, where $T'_1$ and $T'_3$ are the relative amplitudes of the $H_{10}$ and $EH_{12}$ modes respectively.

Figure 5:
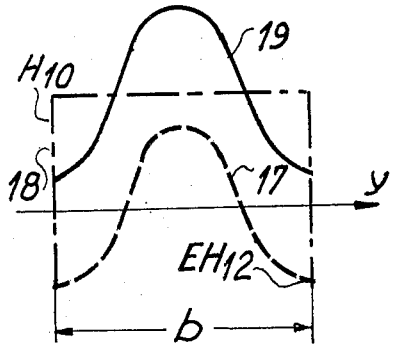
FIG. 5 represents the illumination characteristic of the moder in the E plane.

To facilitate comprehension of the foregoing, FIG. 4 shows the structure of the moder according to the invention in the E plane and FIG. 5 shows the illumination characteristic obtained at the aperture 16 in the E plane. The resultant amplitude 19 of the field is the sum of the amplitude of the $E_{12}$ mode (curve 17) representing the function $\cos(2\pi Y/b)$ and the amplitude of the fundamental mode $H_{10}$ (curve 18).

The operation of the moder according to the invention in the H plane will now be explained with reference to FIGS. 6, 7 and 8.

Figure 6:
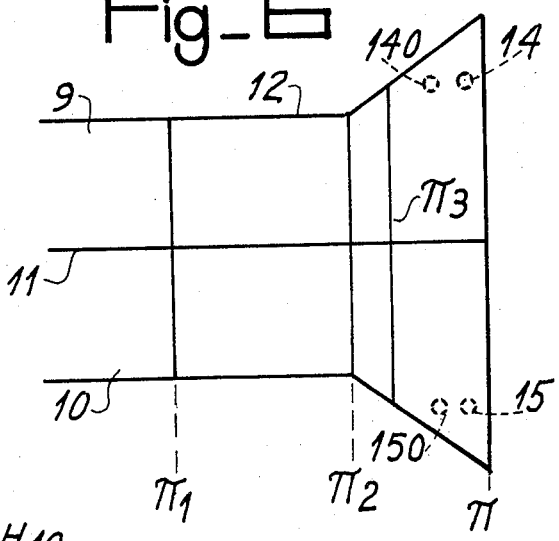
FIG. 6 is a view of the moder in the H plane.

FIG. 6 shows the moder in the H plane, which is perpendicular to the E plane, with the requisite elements taken over from FIG. 2. There can be seen in particular the combined supply guides 9 and 10 which are separated by partition 11 adjacent the horizontal upper plane of guide 12.

The field across the aperture on the sum channel is of the form $S_H = \cos(\pi x/a) + (T_3/T_1)\cos(\pi x/a)$ and on the difference channel it is $$D_H = \sin 2\pi x/a,$$

with $|x| < a/2$. $T_1$ and $T_3$ respectively represent the amplitudes of the fundamental mode $H_{10}$ and the mode $H_{30}$ which is generated in the mouth of the horn 13 by the bars 14 and 15. In fact, the $H_{30}$ mode has already been generated in the plane of discontinuity $\pi_2$ at the junction of the straight guide 12 and the horn 13 but at that stage it is evanescent. It becomes propagative in the horn beyond a plane marked $\pi_3$, but at a very low level.

It is useful to determine the mode ratio $(T_3/T_1) = \alpha$ in the expression for the field across the aperture on the sum channel.

The limiting conditions require that the electrical field E must be zero at the bars. Taking $x = \pm(c/2)$, c being the distance separating the two bars 14 and 15, we obtain the value of the field $S_H$ at the point $X = (c/2)$, i.e. at the center of the aperture, namely:

$$S_H = \cos\frac{\pi c}{2a} + \alpha\cos\frac{3\pi c}{2a} = 0$$

$$\text{which gives } \alpha = -\frac{\cos\frac{\pi c}{2a}}{\cos\frac{3\pi c}{2a}}$$

The illumination characteristic across the aperture can therefore be expressed as:

$$S_H = \cos\frac{\pi x}{a} - \frac{\cos\frac{\pi c}{2a}}{\cos\frac{3\pi c}{2a}} \cdot \cos\frac{3\pi x}{a}$$

By altering the spacing between the bars 14 and 15, the mode ratio $\alpha$ and thus the pattern of illumination in the aperture can be altered.

In producing the moder, the bars must be of a relatively small diameter less than one tenth of the wavelength. As to the positions of the bars it can be assumed that $0 < (a - c) < (a/3)$.

The bars 14, 15 can be replaced by the aforementioned metal plates 141, 151 (FIG. 3) without affecting the results. If the width of the plates is close to $\lambda/4$, their presence does not cause the horn to become mismatched. However, to prevent the horn from becoming mismatched on account of the presence of the bars, we prefer to provide a second pair of bars 140, 150 which are identical to the first pair 14, 15 but situated a distance of $\lambda/4$ behind them in the mouth of the horn.

Figure 7:
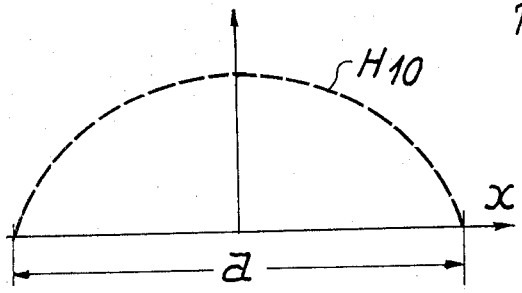
FIG. 7 represents the illumination characteristic of the moder in the H plane with no bars present.
Figure 8:
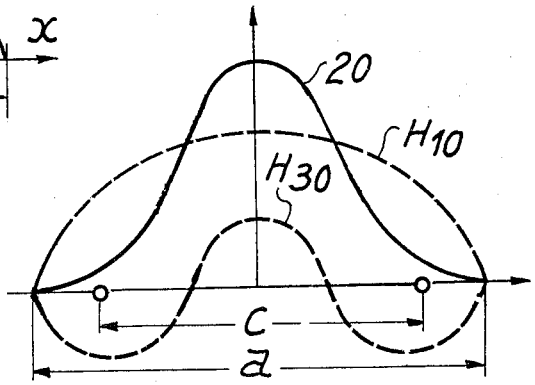
FIG. 8 represents the illumination characteristic of the moder in the H plane with bars present.

FIG. 7 shows the illumination across the aperture in the absence of bars or plates whereas FIG. 8 shows the illumination when the bars or plates are present. Curve 20 shows the resulting amplitude of the field in the aperture of the moder in the H plane.

The operation of the complete mixed moder can be deduced from the foregoing.

The illumination characteristics across the aperture are as follows:

sum channel: $S(xy) = S_H \cdot S_E$ difference channel E plane: $D_E(xy) = S_H \cdot D_E$ difference channel H plane: $D_H(xy) = D_H \cdot S_E$ whence $$S(xy) = (\cos\pi x/a + \alpha\cos 3\pi x/a)(1 + \beta\cos 2\pi y/b)$$

$$D_E(xy) = \left(\cos\frac{\pi x}{a} + \alpha\cos\frac{3\pi x}{a}\right)\sin\frac{\pi y}{b}$$

$$D_H(xy) = \sin\frac{2\pi x}{a}\left(1 + \beta\cos\frac{2\pi y}{b}\right)$$

There has thus been described a mixed E-plane and H-plane moder structure whose longitudinal dimensions are smaller than those of a prior-art mixed moder formed by an E plane moder, a transition, and an H-plane moder. The longitudinal dimensions are approximately 2.5 to 3 times smaller than those of the prior-art moder. Furthermore, in the moder according to the invention and in contrast to the prior-art moder the illumination patterns in the two planes are controlled simultaneously.

If the above expressions are considered, it will be seen that in the E plane the passband is unaltered in comparison with that of a conventional multimode feed such as the prior-art feed; it is of the order of 10%.

In the H plane the passband is better than that obtained with a conventional multimode feed. The passband obtained is of the order of nearly 15% as against 7%. This is due to the fact that the upper mode is generated in the actual aperture of the moder, the in-phase relationship being constant whatever the frequency.

Furthermore, the flared shape of the horn in the H plane gives a quadratic phase to the illumination pattern which results in a primary radiation pattern of constant angular width in the frequency band to be covered.

Experimental measurements have also shown that the phase center in the E plane is situated in the aperture of the horn when plotted in the Fraunhofer region. In the H plane, the phase center is situated in the plane of the bars. This results in illumination of the optical system employed which gives maximum gain and minimum side lobes.

PERTINENT ART:

U.S. Pat. Nos. 3,701,163 and No. 2,825,062

French Pat. No. 2,012,758

International Journal of Electronics, 1969, vol. 26, No. 6, pages 561–572

We claim:

1. A multimode moncpulse feed comprising an E-plane multimode structure producing the E function, an H-plane multimode structure producing the H function, the aperture of the H-plane structure forming the aperture of the multimode microwave feed, a group of waveguides connected to the input of said E-plane structure, which waveguides are excited in the fundamental mode, said E-plane multimode structure terminating in a flared horn presenting an aperture, at least two obstacles being placed in said aperture in such a way that said obstacles have a longitudinal dimension parallel to the electric field in said aperture, said obstacles generating an odd propagative upper mode of the $H_{30}$ type, the said multimode structure forming a mixed E-plane and H-plane structure of reduced length in whose aperture the E-plane and H-plane illumination characteristics are controllable independently but simultaneously.

2. A multimode monopulse feed according to claim 1, having a longitudinal dimension corresponding to that of said E-plane structure.

3. A multimode monopulse feed according to claim 1 wherein the odd upper mode of the $H_{30}$ type is generated in the very aperture of the feed, the in-phase relationship being constant whatever the frequency, resulting in an increased passband.

4. A multimode monopulse feed according to claim 3 wherein the passband is of the order of 15%.

5. A multimode monopulse feed according to claim 1 wherein the obstacles inserted in the aperture of the feed parallel to the electrical field of the emitted wave are bars arranged symmetrically about the axis of the aperture and separated by a distance c less than the length a of the aperture and such that $O<(a-c)<a/3$.

6. A multimode monopulse feed according to claim 5 wherein a second pair of bars situated in said aperture a quarter wavelength upstream of the first pair is provided for matching the feed.

7. A multimode monopulse feed according to claim 1 wherein the obstacles inserted in the aperture of the feed are plates having a width of the order of a quarter wavelength 8. A multimode monopulse feed according to claim 1 wherein the aperture of the structure is pyramidal and produces a square phase law which stabilizes the angular width of the radiation patterns in the H plane.

9. A multimode monopulse feed according to claim 1 wherein the phase centers in the E plane and the H plane coincide.

* * * * *